US007537413B1

(12) United States Patent
Brugos

(10) Patent No.: US 7,537,413 B1
(45) Date of Patent: May 26, 2009

(54) ADJUSTABLE MANHOLE COVER APPARATUS

(76) Inventor: Ricardo Brugos, 65 SW. 19th Rd., Miami, FL (US) 33129

( * ) Notice: Subject to any disclaimer, the term of this patent is extended or adjusted under 35 U.S.C. 154(b) by 0 days.

(21) Appl. No.: 11/965,284

(22) Filed: Dec. 27, 2007

Related U.S. Application Data

(60) Provisional application No. 60/883,803, filed on Jan. 7, 2007.

(51) Int. Cl.
*E04D 13/00* (2006.01)

(52) U.S. Cl. ..... 404/25

(58) Field of Classification Search ..... 404/25, 404/26; 52/19, 20
See application file for complete search history.

(56) References Cited

U.S. PATENT DOCUMENTS 3,858,998 A 1/1975 Larsson et al.
4,050,839 A * 9/1977 Vollmar ..... 404/72
4,662,777 A * 5/1987 Newton ..... 404/25
5,876,533 A * 3/1999 House et al. ..... 156/71
7,153,057 B1 * 12/2006 Lucas ..... 404/25
7,225,587 B2 * 6/2007 Shinehouse et al. ..... 52/19
2002/0025223 A1 2/2002 Suatac
2002/0136604 A1 9/2002 Sondrup

* cited by examiner

*Primary Examiner*—Gary S Hartmann

(57) ABSTRACT

An adjustable manhole cover apparatus designed to fill a gap of any size or shape between a manhole and a resurfaced road pavement. The preferred embodiment provides a plastic bag filled with cement or heavy foam to fill the gap and an aluminum lid. The plastic bag prevents the filling from sticking to the pavement and manhole, while being heavy enough to support vehicles passing over the filling. Accordion-shaped versions provide accordion-shaped forms, with one incorporating a manhole cover, to be filled to eliminate the gap between a manhole cover and pavement.

12 Claims, 7 Drawing Sheets

ADJUSTABLE MANHOLE COVER APPARATUS

CROSS-REFERENCE TO RELATED APPLICATIONS

U.S. Provisional Application No. 60/883,803 filed on Jan. 7, 2007

FEDERALLY SPONSORED RESEARCH OR DEVELOPMENT

Not Applicable

INCORPORATION BY REFERENCE OF MATERIAL SUBMITTED ON A COMPACT DISK

Not Applicable

FIELD OF THE INVENTION

The present invention relates to manhole cover devices and, more specifically, to an adjustable manhole cover apparatus as described in this specification.

BACKGROUND OF THE INVENTION

Prior art provides various manhole frames and cover devices. These frames and cover devices attempt to obtain a manhole height which has a desired level in relation to the original or resurfaced paving of a street or highway, which is not labor-intensive to achieve, and which is relatively cost-effective. The present adjustable manhole cover apparatus provides a plastic bag filled with cement or heavy foam to fill the gap between a manhole cover and the street pavement surface and a lid over the filling. Alternative embodiments provide am accordion shaped form, one of which does not incorporate a manhole cover and the other which incorporates a manhole cover, to be filed to eliminate the gap between a manhole cover and the street pavement.

SUMMARY OF THE INVENTION

The present adjustable manhole cover apparatus is designed to fill the recess over a manhole when a resurfaced road pavement becomes more elevated than an existing utility cover. Nearly every gap between a resurfaced pavement and a manhole cover is different. The present apparatus is adjustable to fill a gap of any size or shape. The preferred embodiment of the present adjustable manhole cover apparatus is a "plastic bag version" which provides a plastic bag filled with fill material to fill the gap between a manhole cover and the street pavement surface and a lid over the filling. The fill material is cement or heavy foam. The apparatus is constructed from durable materials. The lid is constructed from durable plastic, aluminum, or a metal having similar properties. Filling the plastic bag with fill material not only fills the hole, but also prevents the cement or foam from sticking to the pavement or the manhole, while further being heavy enough to support vehicles passing over it. Alternative embodiments are "accordion-shaped versions" which provide a vertically expandable helical rib assembly, one version incorporating a manhole cover and the other which does not incorporate a manhole cover, to be filled to eliminate the gap between a manhole cover and the street pavement. The accordion shaped form which does not incorporate a manhole cover is constructed from plastic, while the form which incorporates a manhole cover has a form constructed from plastic with a manhole cover being constructed from aluminum or metal with similar properties. Yet another alternative embodiment incorporates a threaded piece affixed to the lower end of an accordion shaped form for threading the threaded piece into a manhole cover. Still another alternative embodiment incorporates a threaded piece affixed to the lower end of the accordion shaped form, as well as a manhole cover affixed to the bottom end of the threaded piece.

The present apparatus is provided in a range of sizes, shapes, and thicknesses. The lids are provided in a variety of sizes and thickness to fill a gap between the manhole and a resurfaced road pavement surface. The present apparatus may also be used to fill a gap created by a utility valve access cover.

The present apparatus fulfills the need for an improved method of building up the height of a manhole. No tools are required to install the apparatus. It is easy to use and reduces the time and effort required to fill a gap between a manhole and a resurfaced street pavement when compared to the time and effort required using prior art devices and methods. Thus, the need to close a street for hours or days is reduced. The present apparatus enables the manhole gap to be filled to make a perfectly flush road surface, thereby eliminating the formation of pothole-like road dips.

The present adjustable manhole cover apparatus may be useful for any road repair situation, such as resurfacing of pavement by various federal, state, and local departments of transportation or road and bridge departments or by private road work or parking lot resurfacing projects. The present device reduces driving hazards created by gaps in road surfaces, such as tire blow-outs.

As such, the general purpose of the improved adjustable manhole cover apparatus which has all of the advantages of the prior art mentioned heretofore and many novel features that result in an improved adjustable manhole cover apparatus which is not anticipated, rendered obvious, suggested, or even implied by the prior art, either alone or in combination thereof.

An object of the present adjustable manhole cover apparatus to provide an adjustable manhole cover apparatus which fills any gap between a resurfaced street pavement and a manhole.

Another object of the present adjustable manhole cover apparatus is to provide an efficient and time-saving apparatus for filling a gap between a resurfaced street pavement and a manhole.

Yet another object of the present adjustable manhole cover apparatus is to create a perfectly flush road surface when filling a gap between a resurfaced road pavement and a manhole.

A further object of the present adjustable manhole cover apparatus is to fill a gap between a road pavement surface and a manhole without the use of tools.

Still another object of the present apparatus is to reduce driving hazards created by gaps between road surfaces and manholes.

Still yet another object of the present adjustable manhole cover apparatus is to provide a manhole cover apparatus which not only fills a hole or gap between a resurfaced pavement and manhole, but which also does not stick to the pavement or the manhole, while also being heavy enough to withstand vehicles passing over the filled gap.

Thus has been broadly outlined the more important features of the improved adjustable manhole cover apparatus so that the detailed description thereof that follows may be better understood and in order that the present contribution to the art may be better appreciated.

These together with additional objects, features and advantages of the improved adjustable manhole cover apparatus will be readily apparent to those of ordinary skill in the art upon reading the following detailed description of presently preferred, but nonetheless illustrative, embodiments of the improved adjustable manhole cover apparatus when taken in conjunction with the accompanying drawings. In this respect, before explaining the current embodiments of the improved adjustable manhole cover apparatus in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and kits for carrying out the several purposes of the improved adjustable manhole cover apparatus. It is therefore important that the claims be regarded as including such equivalent constructions insofar as they do not depart from the spirit and scope of the present invention.

Objects of the improved adjustable manhole cover apparatus, along with various novel features that characterize the invention are particularly pointed out in the claims forming a part of this disclosure. For better understanding of the improved adjustable manhole cover apparatus, its operating advantages and specific objects attained by its uses, refer to the accompanying drawings and description.

DETAILED DESCRIPTION OF THE DRAWINGS

With reference now to the drawings, and in particular FIGS. 1 through 10 thereof, examples of the employing the principles and concepts of the present adjustable manhole cover apparatus, generally designated by the reference number 10, will be described.

Figure 1:
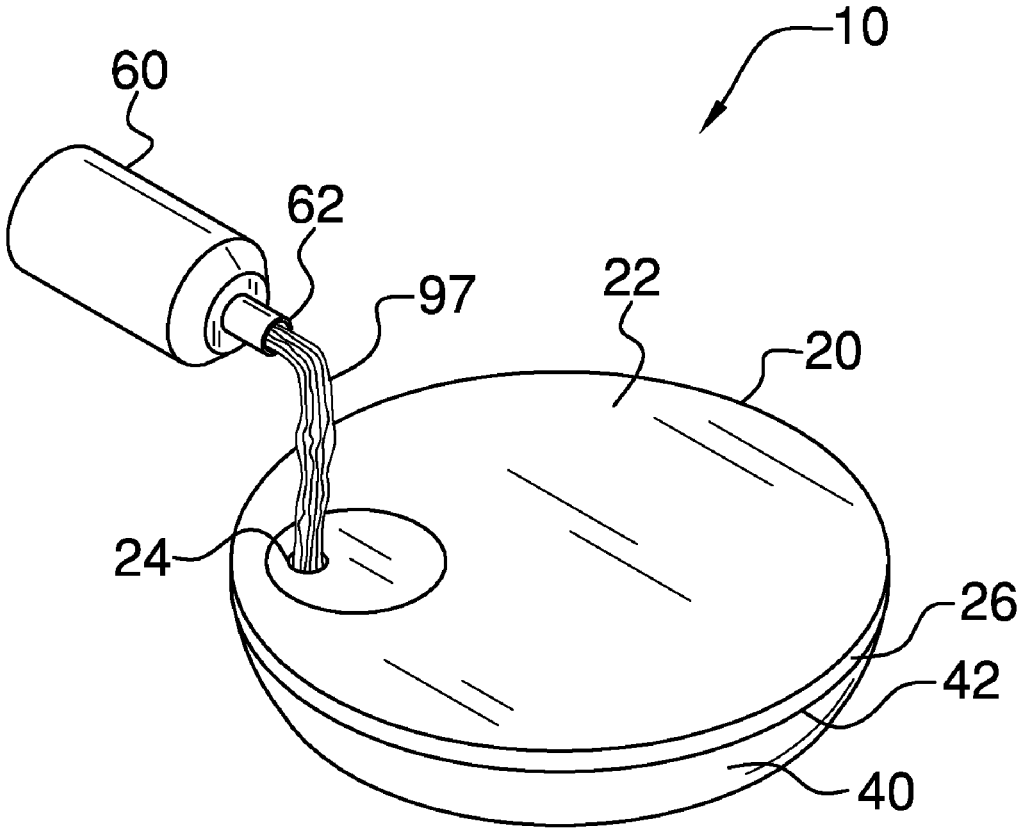
FIG. 1 is an in-use perspective view.
Figure 2:
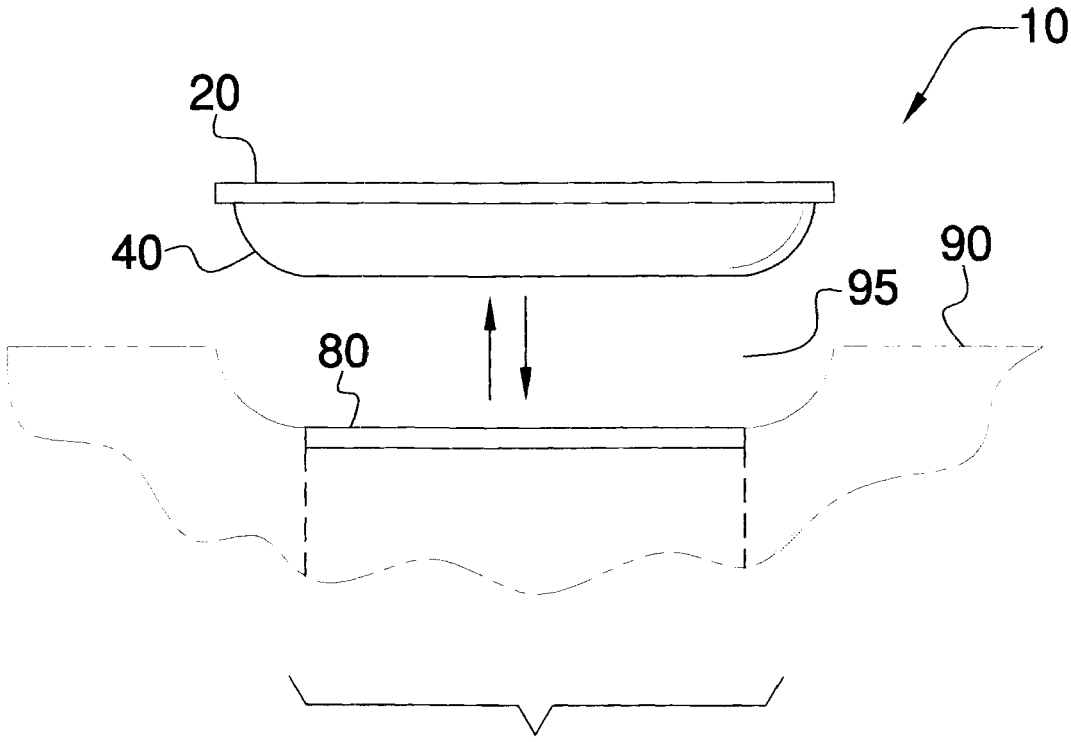
FIG. 2 is a side elevation view illustrating a lid holding a filled plastic bag to fill a gap between a manhole cover and pavement surface.

Referring to FIGS. 1 through 10, the present adjustable manhole cover apparatus 10 is intended to fill a gap 95 in a resurfaced road pavement surface 90 or a gap 95 between a manhole utility cover 80 and a resurfaced road pavement surface 90. The preferred embodiment of present apparatus 10, as illustrated in FIGS. 1-2, also referred to herein as a "plastic bag" embodiment, comprises a disk-shaped lid 20, a plastic bag 40, and a container 60 for containing an amount of fill material 97. The disk-shaped lid 20 has a flat top side 22, an aperture 24 in said top side 22, and a downwardly turned lip edge 26 continuously affixed to the circumference of said top side 22. The lid 20 is constructed from metal, the metal being aluminum, steel, or other metal with similar properties. The plastic bag 40 has an open end 42, the open end being continuously and sealingly affixed to the lip edge 26 of the lid 20. The fill material 97 is concrete or heavy foam. The container 60 has a mouth 62 from which said fill material 97 is poured into said aperture 24 and then the fill material 97 flows into said plastic bag 40 in which the fill material 97 hardens to conform to the shape of the gap 95 after the bag 40 has been placed into the gap 95.

Figure 3:
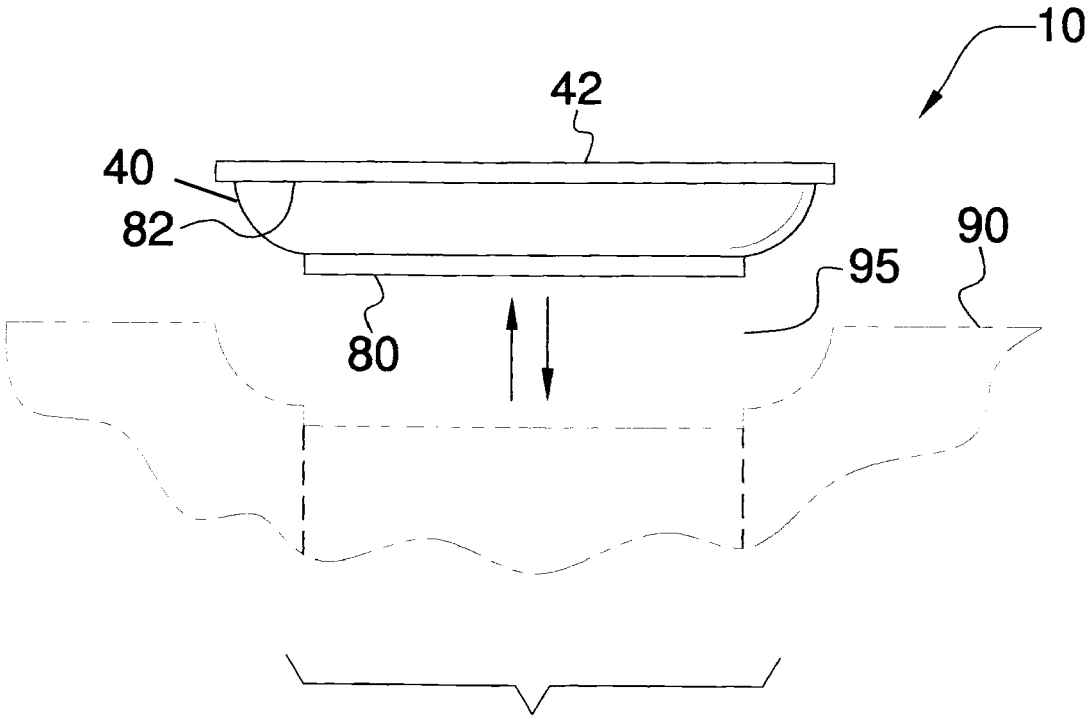
FIG. 3 is a side elevation view illustrating utility cover assembly having a filled plastic bag incorporated therein to fill a gap between a street pavement subsurface and surface.
Figure 4:
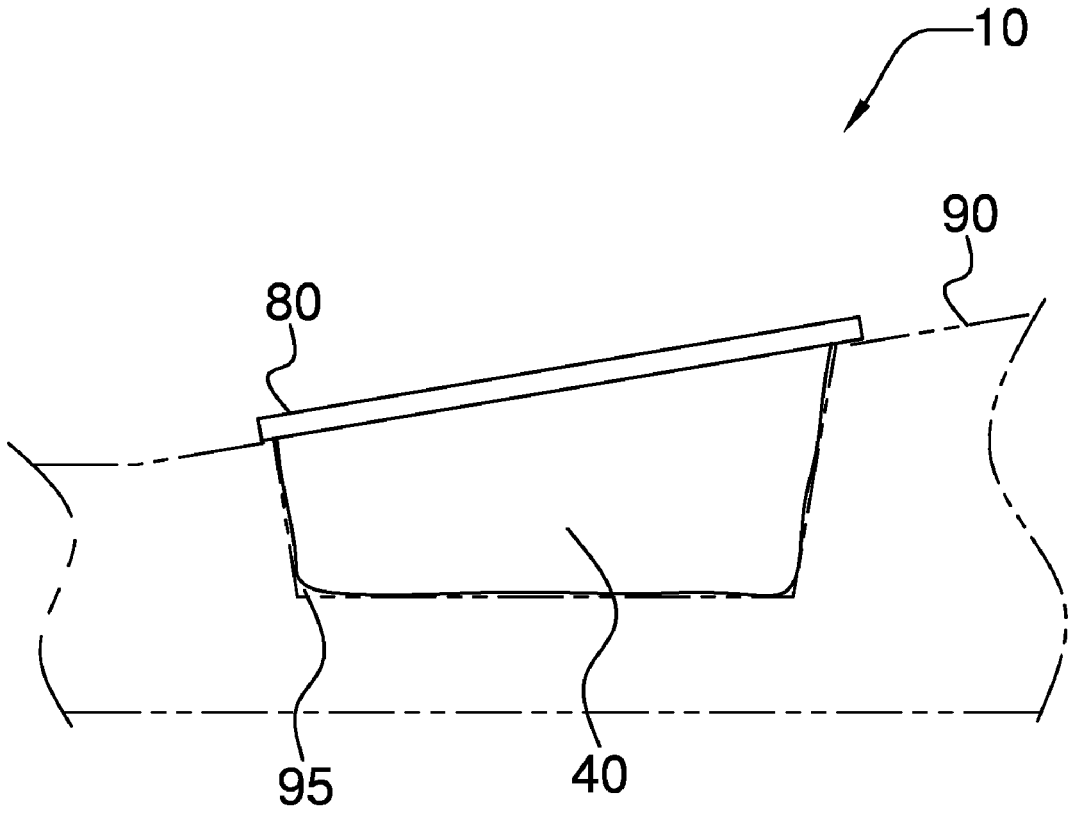
FIG. 4 is an in-use side elevation view illustrating a filled plastic bag filling a gap in a non-level street between a pavement subsurface and surface.

FIGS. 3 and 4 illustrate an alternative embodiment providing a manhole cover 80 into which a plastic bag 40 is inserted with the open end 42 being slightly turned back over the upper edge 82 of the manhole cover 80. The plastic bag 40 is filled with fill material which conforms to the shape of the gap 95 and hardens in the conforming shape.

Figure 5:
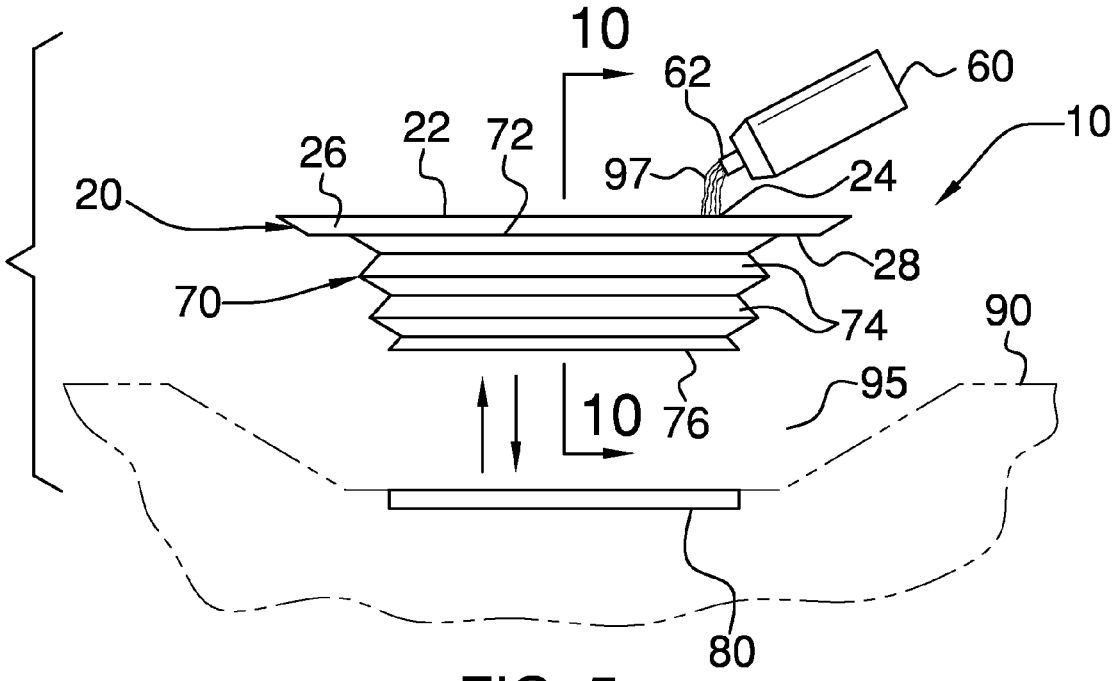
FIG. 5 is an in-use side elevation view of an alternative embodiment illustrating the filling of and placement of an accordion shaped apparatus into a utility manhole cover.
Figure 10:
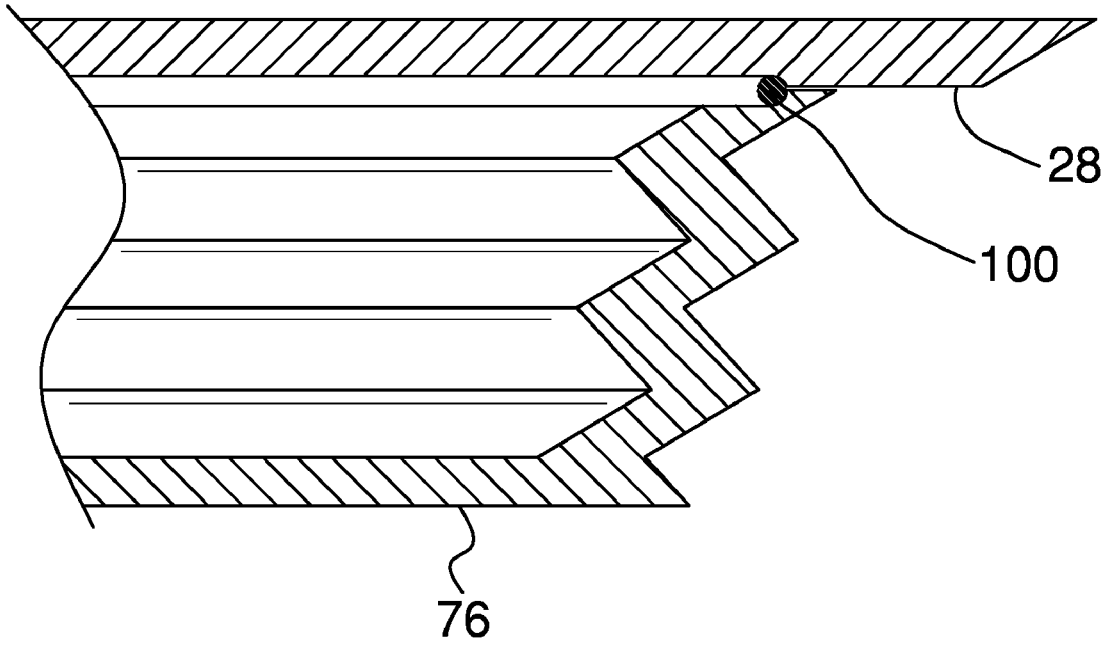
FIG. 10 is a cross-section view taken along line 10-10 of FIG. 5.

FIGS. 5 and 10 illustrate an alternative "accordion-style" embodiment which provides a disk-shaped lid 20, a rib assembly 70, an amount of fill material 97 to fill the rib assembly 70, and a container 60 containing the fill material 97. The disk-shaped lid 20 has a flat top side 22, an aperture 24 in the top side 22, and a downwardly turned lip edge 26 continuously affixed to the circumference of said top side 22, said lip edge 26 having a continuous bottom edge 28. The rib assembly 70 is generally cylindrical and provides an open top end 72, the top end 72 being sealingly continuously affixed to the bottom edge 28 of the lip edge 26 of the lid 22 by a sealing layer 100, a plurality of vertically expandable integral helical ribs 74 arranged atop one another, and a bottom end 76 which is closed. The rib assembly 70 is placed into the manhole cover 80. Said container 60 has a mouth 62 from which to pour said fill material 97 into said rib assembly 70 after said rib assembly 70 is placed into the manhole cover 80.

Figure 6:
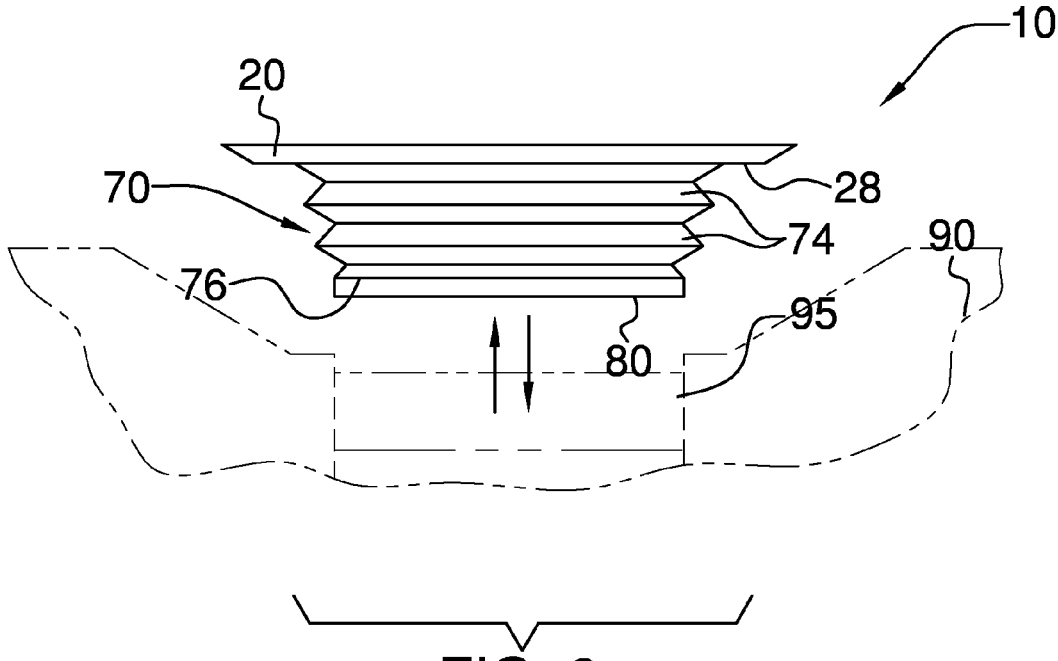
FIG. 6 is an in-use side elevation view of an alternative embodiment illustrating the installation of a one-piece accordion shaped apparatus incorporating a manhole for filing a gap in street pavement.

FIG. 6 illustrates another alternative "accordion-style" embodiment which provides the same elements as the FIG. 5 embodiment except a manhole cover 80 is continuously and sealingly attached to the rib assembly 70 bottom end 76, which is open.

Figure 7:
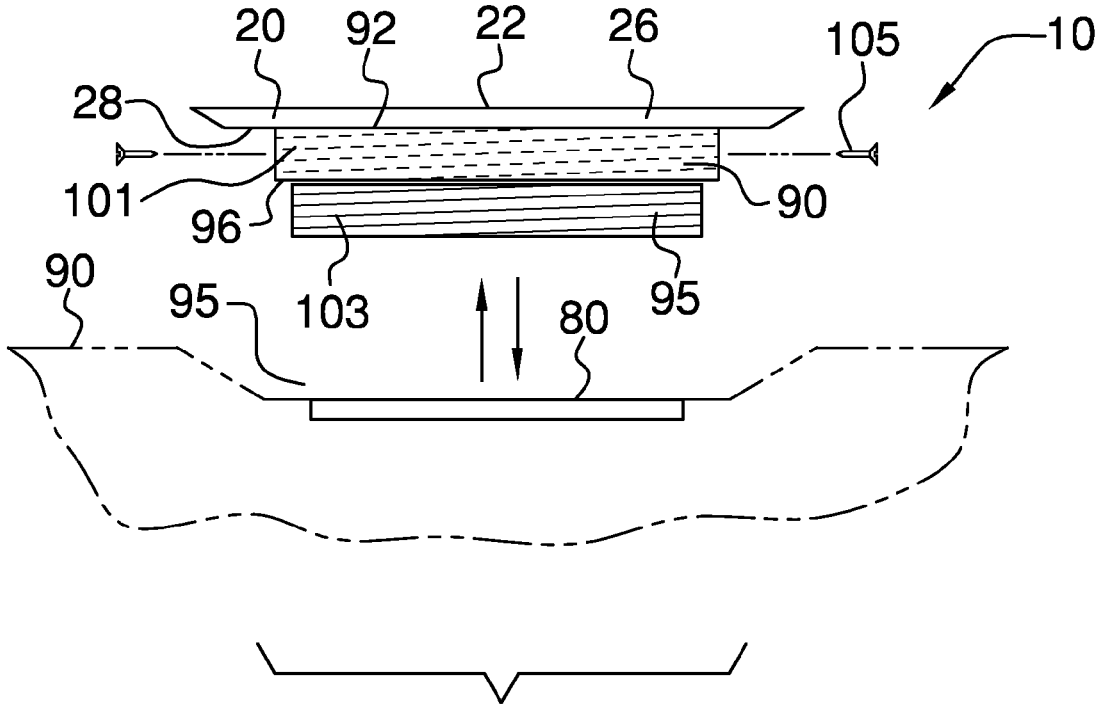
FIG. 7 is a side elevation view illustrating an alternative embodiment of an accordion-shaped form having a threaded portion for installation into a manhole cover.

FIG. 7 illustrates yet another embodiment which provides a disc-shaped lid 20, a disc-shaped threaded base 90, and a disc-shaped threaded assembly 95. The disk-shaped lid 20 has a flat top side 22, an aperture in the top side 22, and a downwardly turned lip edge 26 continuously affixed to the circumference of said top side 22, said lip edge 26 having a continuous bottom edge 28. The disc-shaped threaded base 90 comprises an open upper end 92, the upper end 92 being sealingly and continuously affixed to the bottom edge 28 of the lip edge 26 of the lid 22, a lower end 96 and a plurality of horizontally arranged female threads 101 therebetween which cooperate with a plurality of male threads 103 in the threaded assembly 95. The threaded assembly 95 screws into the base 90 to adjust the manhole cover apparatus 10 to the height of the gap 95 such that said lid 20 is even with the pavement surface. A securing means for securing the threaded assembly 95 to the threaded base 90 once the height is properly adjusted is provided. Said securing means is a plurality of screws 105 which are screwed into the sides of the threaded assembly 90 and threaded base 90 or nails which are nailed into the sides.

Figure 8:
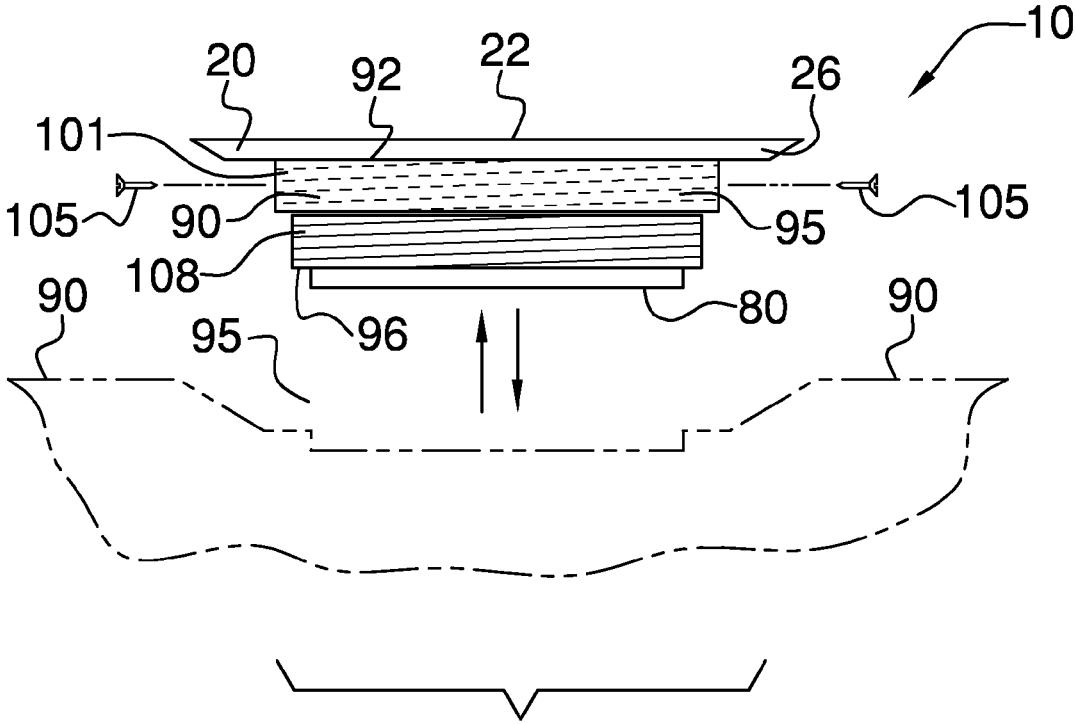
FIG. 8 is a side elevation view of an alternative embodiment illustrating installation an accordion-shaped incorporating a threaded portion and a manhole cover incorporating a manhole cover to fill a street pavement gap.

FIG. 8 illustrates still yet another embodiment which provides a disc-shaped lid 20, a disc-shaped threaded base 90, a disc-shaped threaded assembly 95, and a manhole cover 80 attached to a distal end 96 of the threaded assembly 95. The disk-shaped lid 20 has a flat top side 22, an aperture in the top side 22, and a downwardly turned lip edge 26 continuously affixed to the circumference of said top side 22, said lip edge 26 having a continuous bottom edge 28. The disc-shaped threaded base 90 comprises an open upper end 92, the upper end 92 being sealingly and continuously affixed to the bottom edge 28 of the lip edge 26 of the lid 22, a lower end 96 and a plurality of horizontally arranged female threads 101 therebetween which cooperate with a plurality of male threads 103 in the threaded assembly 95. The threaded assembly 95 screws into the base 90 to adjust the manhole cover apparatus 10 to the height of the gap 95 such that said lid 20 is even with the pavement surface. A securing means for securing the threaded assembly 95 to the threaded base 90 once the height is properly adjusted is provided. Said securing means is a plurality of screws 105 which are screwed into the sides of the threaded assembly 90 and threaded base 90 or nails which are nailed into the sides.

Figure 9:
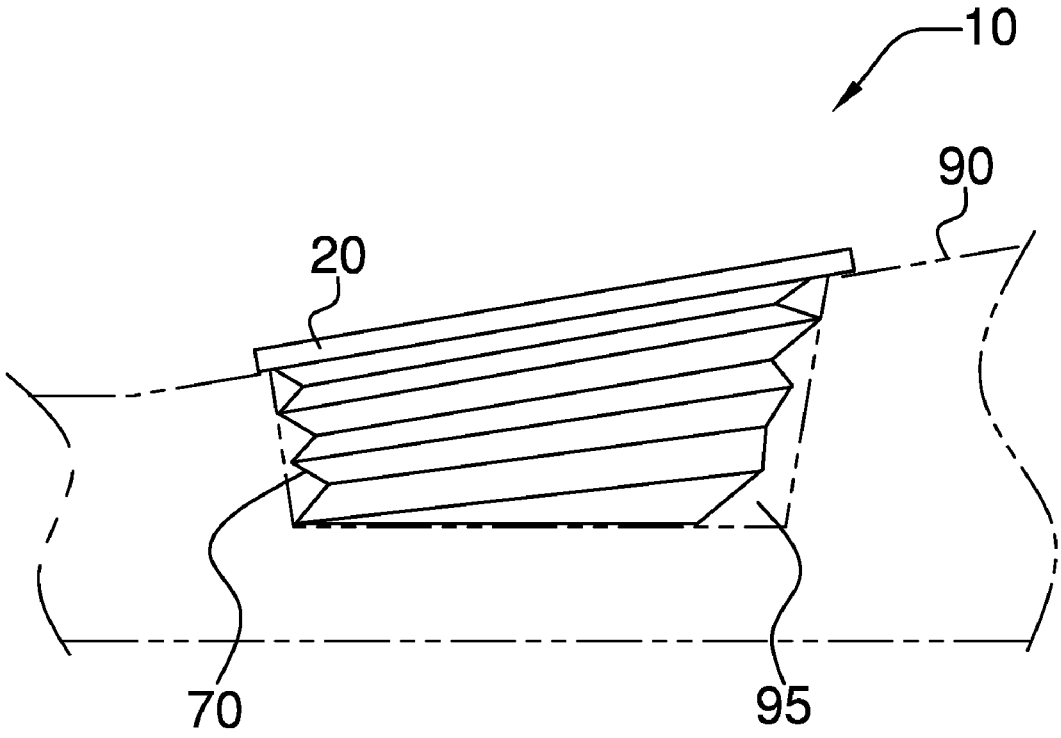
FIG. 9 is a side elevation view of installation of an accordion-shaped form into a manhole cover to fill an unlevel street surface pavement gap.

FIG. 9 illustrates the positioning of an accordion-shaped embodiment featuring a rib assembly 70, according to FIG. 6, to fill a gap 95 in a street which has an uneven pavement surface 90.

Method of Use:

To fill a gap between a manhole and a resurfaced road pavement surface comprising, a user begins by selecting a lid having the same size and thickness as said gap. pouring fill material into the aperture on the top side of the lid until the plastic bag is filled; placing said filled plastic bag over said utility cover and maneuvering said plastic bag to place the lid into the gap and even with the pavement.

With respect to the above description then, it is to be realized that the optimum dimensional relationships for the parts of the adjustable manhole cover apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An adjustable manhole cover apparatus comprising:
- a disk-shaped lid comprising:
  - a flat top side,
  - an aperture in said top side;
  - a downwardly turned lip edge continuously affixed to the circumference of said top side,
- a plastic bag having an open end, the open end being continuously and sealingly affixed to the lip edge of the lid by a sealing layer;
- an amount of fill material to fill said plastic bag;
- a container having a mouth from which said fill material can be poured into said aperture and into said plastic bag.

2. The adjustable manhole cover apparatus of claim 1 wherein said fill material is concrete.

3. The adjustable manhole cover apparatus of claim 1 wherein said fill material is heavy foam.

4. The adjustable manhole cover apparatus of claim 2 wherein said lid is constructed from metal.

5. The adjustable manhole cover apparatus of claim 3 wherein said lid is constructed from metal.

6. An adjustable manhole cover apparatus intended to fill a gap between a manhole and a resurfaced road pavement surface comprising:
- a disk-shaped lid comprising:
  - a flat top side,
  - an aperture in said top side;
  - a downwardly turned lip edge continuously affixed to the circumference of said top side, said lip edge having a continuous bottom edge,
- a cylindrical rib assembly comprising:
  - an open top end, the top end being sealingly affixed to the bottom edge of the lip edge of the lid by a sealing layer;
  - a plurality of vertically expandable integral helical ribs arranged atop one another;
  - a closed bottom end;
  - an amount of fill material to fill said rib assembly; and
- a container having a mouth from which said fill material can be poured into said aperture and into said plastic bag.

7. The adjustable manhole cover apparatus of claim 6 wherein said fill material is concrete.

8. The adjustable manhole cover apparatus of claim 6 wherein said fill material is heavy foam.

9. The adjustable manhole cover apparatus of claim 6 further comprising a manhole cover affixed to said closed bottom end of said rib assembly.

10. The adjustable manhole cover apparatus of claim 7 further comprising a manhole cover affixed to said closed bottom end of said rib assembly.

11. The adjustable manhole cover apparatus of claim 8 further comprising a manhole cover affixed to said closed bottom end of said rib assembly.

12. A method of using the adjustable manhole cover apparatus of claim 1 to fill a gap between a manhole and a resurfaced road pavement surface comprising:
- selecting a lid having the same size and thickness as said gap;
- pouring fill material into the aperture on the top side of the lid until the plastic bag is filled;
- placing said filled plastic bag over said utility cover and maneuvering said plastic bag to place the lid into the gap and even with the pavement.

* * * * *